US008322401B2

(12) United States Patent
Benedetti

(10) Patent No.: US 8,322,401 B2
(45) Date of Patent: Dec. 4, 2012

(54) CASTING AND CONTINUOUS ROLLING METHOD AND PLANT TO MAKE LONG METAL ROLLED PRODUCTS

(75) Inventor: Gianpietro Benedetti, Tricesimo (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 134 days.

(21) Appl. No.: 12/858,896

(22) Filed: Aug. 18, 2010

(65) Prior Publication Data

US 2012/0018114 A1 Jan. 26, 2012

(30) Foreign Application Priority Data

Jul. 21, 2010 (IT) ..... UD2010A0148

(51) Int. Cl.
*B22D 11/12* (2006.01)
*B22D 11/126* (2006.01)
*B21B 1/46* (2006.01)

(52) U.S. Cl. ..... 164/460; 164/471; 164/476; 164/263; 164/417; 29/527.7

(58) Field of Classification Search ..... 164/460, 164/476, 477, 417, 263, 269, 424, 471, 493, 164/507; 29/33 C, 527.7
See application file for complete search history.

(56) References Cited

U.S. PATENT DOCUMENTS

| | | | | |
|---|---|---|---|---|
| 6,240,763 | B1 * | 6/2001 | Benedetti | 72/239 |
| 2009/0298001 | A1 | 12/2009 | Klein et al. | |
| 2011/0315340 | A1 * | 12/2011 | Benedetti | 164/460 |

FOREIGN PATENT DOCUMENTS

| | | |
|---|---|---|
| DE | 3525457 | 1/1987 |
| EP | 0302257 | 2/1989 |
| EP | 0353487 | 2/1990 |
| WO | 94/18514 | 8/1994 |
| WO | 00/71271 | 11/2000 |

* cited by examiner

*Primary Examiner* — Kevin P Kerns
(74) *Attorney, Agent, or Firm* — Hamre, Schumann, Mueller & Larson, P.C.

(57) ABSTRACT

A method for making long metal rolled products by continuous casting, made by a continuous casting machine to two casting lines; shearing to size of the cast product; direct introduction of each segment, having an average temperature of at least 1000° C.-1150° C., into a maintenance and/or heating furnace that has a first and a second movement sections, each of the movement sections is disposed in axis respectively with one of the two casting lines to receive a respective segment; lateral transfer of each segment inside the furnace to dispose each segment in a third movement section disposed parallel and misaligned with respect to the first and the second movement sections and aligned to a rolling axis of a rolling line parallel and offset with respect to the two casting lines; and reduction of the section in a rolling mill defining said rolling axis.

7 Claims, 9 Drawing Sheets

| | | SEMI-ENDLESS | |
|---|---|---|---|
| Nominal sizes bloom section | mm | 150x150 | 150x150 |
| Casting speed | m/min | 5.7 | 2.8 |
| N. of casting lines | | 2 | 4 |
| Hourly productivity | t/ora | 120 | 120 |
| Annual productivity | t/anno | 800000 | 800000 |
| Metric weight of bloom | t/m | 0.177 | 0.177 |
| Bloom length | m | 52 optimized | 14 optimized |
| Total bloom weight | t | 9 | 2.5 |
| | | | |
| Time lost due to head blockages | h | 90 | 326 |
| Loss of efficiency % | % | 1.19% | 4.30% |
| | | | |
| Total loss of material due to blockages in the train | t | 440 | 1.631 |
| Total loss of material due to blockages in the train | % | 0.05% | 0.20% |
| | | | |
| Total loss of material due to cropping in train and finishing and to short bars (endless 0.4%) | % | 0.75% | 1.70% |
| | | | |
| Scale in the maintenance/heating furnace | % | 0.20% | 0.80% |
| Total yield (furnace+train+finishing) | % | 99.02% | 97.30% |
| Buffer time maintenance/heating furnace | min | 45 | 0 |
| | | | |
| Consumption of natural gas in furnace | $Nm^3/h$ | 900 | 1800 |
| | $Nm^3/t$ | 7.5 | 15 |
| Consumption of natural gas in furnace compared to tradiotional solution | % | 50% | 100% |

| | | |
|---|---|---|
| NB: production time considered net of programmed maintenance | h | 7577 |

fig. 6

CASTING AND CONTINUOUS ROLLING METHOD AND PLANT TO MAKE LONG METAL ROLLED PRODUCTS

FIELD OF THE INVENTION

The present invention concerns a casting and continuous rolling method and plant in semi-endless mode, to make long metal rolled products such as bars, wire rod, beams, rails or sections in general.

BACKGROUND OF THE INVENTION

Continuous casting plants known in the state of the art for the production of long rolled products have considerable limitations in that, for reasons intrinsically connected to operating constraints and performance of the components, their productivity does not generally exceed 25-40 ton/h. Consequently, in order to obtain higher productivity it is necessary to increase the number of casting lines connected to the same rolling line, which can be up to 8 lines or more. This entails, among other things, the need to translate the billets or blooms exiting from the various casting lines on a single entrance point of the heating furnace, with the consequent losses of temperature in the transfers.

The consequence of this is the considerable quantity of energy needed to feed the heating furnace, which is needed to restore the temperature lost and bring it from the entrance value, comprised between 650° C. and 750° C., to the value suitable for rolling, that is, in a range comprised between 1050° C. and 1200° C.

Moreover, the need to transfer the segments of billets or blooms from the various casting lines to the point where they are introduced into the furnace, imposes limitations on the length and therefore the weight: the length of the billets or blooms is comprised between 12 and 14 m, up to a maximum of 16 m, and the weight is on average equal to 2-3 tons.

These process necessities and limitations are the main cause of an increase in energy required for heating the billets or blooms, and of a worsening of the full capacity, due both to the large-sized tundishes that are needed to serve several casting lines and also to the large number of billets or blooms to be processed given the same number of tons/hour to be produced, with consequent high number of crops, heads entering into the stands of the mill and sub-lengths with non-commercial sizes.

One purpose of the present invention is therefore to achieve a casting and continuous rolling process in semi-endless mode (that is, starting from segments of cast products sheared to size) for long rolled products, and perfect a relative production plant which, using only two casting lines associated with a single rolling line, allows to increase productivity compared to similar plants with two casting lines as known in the state of the art.

Another purpose of the present invention is to exploit to the utmost the enthalpy possessed by the original liquid steel along all the production line, reducing temperature losses in the time between shearing the cast product to size and sending it to the rolling step, so as to obtain a considerable saving of energy and a reduction in the running costs compared to conventional processes.

A further purpose of the present invention is to deal with the stoppages of the rolling mill without also having to interrupt the casting process upstream.

Another purpose of the invention is to reduce to a minimum or eliminate the scrap material in emergency situations or during programmed stoppages and so completely recover the product which in these situations is temporarily accumulated in an intermediate point along the production line.

Further purposes of the invention are:

to reduce investment costs thanks to the reduction in the number of casting lines given the same production;

to guarantee a higher yield, equal to the ratio between weight of the finished product and weight of the liquid steel to produce a ton;

to reduce the risks of cobbles during rolling process thanks to the reduction in the number of entering heads;

to obtain a greater stability of the rolling mill and a better dimensional quality of the finished product;

to bring the performance of a semi-endless process much closer to that of an endless process, that is, without solution of continuity between the continuous casting machine and the rolling unit;

to guarantee the possibility of changes in production in dimension and type without stopping the continuous casting, obtaining a higher plant utilization factor.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe or variants to the main inventive idea.

A casting and continuous rolling plant of the semi-endless type for the production of long rolled products according to the present invention comprises a continuous casting machine, comprising two parallel casting lines that feed a cast product, directly and without intermediate movements, to a maintenance and/or possible heating furnace downstream of which there is a rolling line which is offset and parallel with respect to said casting lines.

Each casting line has a respective crystallizer which can cast products, in relation to thickness, at a variable speed between 3 and 9 m/min.

Altogether, the casting machine with two lines allows to obtain an hourly productivity which varies from 35 tons/h to 240 tons/h which corresponds to an annual productivity which varies from 600,000 tons/year to 1,500,000 tons/year.

Each of the two crystallizers can produce products with a square or rectangular section or equivalent, for example with curved, rounded sides, with rounded edges etc.

In the description and in the claims, by the term bloom we mean a product with a rectangular or square section in which the ratio between the long side and the short side is comprised between 1 and 4, that is, between the square section and the rectangular section in which the long side can be up to 4 times longer than the short side.

In the present invention the section of the cast product is not limited, as we said, to a quadrangular or rectangular section with straight and two by two parallel sides, but also comprises sections with at least a curved, concave or convex side, advantageously but not necessarily two by two opposite and specular, or combinations of the aforesaid geometries.

A rectangular section has a greater surface than a square section having the same height or thickness, so that casting this type of section we obtain, given the same casting speed, a greater quantity in tons of material in the unit of time, that is, an increase in hourly productivity.

The height or the thickness of the rectangular section, or the side of the square section, are reference parameters for the determination of the radius of curvature of the casting lines, and therefore their bulk, upon which the length of the metallurgical cone also depends. Therefore, according to the present invention, in order to increase the productivity, it is advantageous, when a bloom of rectangular section is cast, to maintain the height of its section to a value congruous to the design radius of curvature of the continuous casting machine and instead to increase its width, which can be up to three or four times more.

Moreover, for a given productivity, it is advantageous to provide two casting lines, rather than one, since in this case the ratio between width and height of the rectangular section or the side of the square section is reduced, therefore allowing the reduction in the number of rolling stands needed.

In accordance with the present invention, the cast section of the cast product has a surface equal to that of a square with equivalent sides comprised between 100 and 300 mm.

Simply to give an example, the square sections which are produced by each continuous casting line have dimensions which vary from about 100 mm×100 mm, 130 mm×130 mm, 150 mm×150 mm, 160 mm×160 mm or intermediate dimensions; in order to increase productivity, rectangular sections having dimensions which vary from 100 mm×140 mm, 130 mm×180 mm, 130 mm×210 mm, 140 mm×190 mm, 160 mm×210 mm, 160 mm×280 mm, 180 mm×30 mm, 200 mm×320 mm or intermediate dimensions can also be produced. In the case of the production of average profiles, even bigger dimensional sections can be used, for example of about 300 mm×400 mm and similar.

The casting machine according to the present invention therefore allows to reduce the number of casting lines needed for a plant to only two, given the same productivity, thus allowing to obtain a better yield, or full capacity, thanks to the fact that it is possible to use a smaller tundish, with less refractory consumption.

The rolling line also comprises, downstream from the continuous casting, shearing means suitable to cut the blooms to size into segments of a desired length. By desired length of the segments we mean a value comprised between 16 and 150 meters, preferably between 16 and 80 meters, more preferably between 40 and 60 meters, and comprised between 10 and 100 ton in weight. The optimum measurement of the segment is identified on each occasion on the basis of the type of product and the process modes, in the manner indicated hereafter in greater detail.

A maintenance and/or possible heating unit is located downstream from the casting machine, into which unit said segments, sheared to size, enter directly and without intermediate movements and/or transfers, at an average temperature of at least 1000° C., preferably comprised between about 1100° C. and about 1150° C. The average temperature at which the bloom exits from the furnace is comprised between about 1050° C. and 1200° C.

In some embodiments, not restrictive for the scope of the invention, at exit from the maintenance and/or possible heating furnace, or in any case downstream of it, there may be an inductor which has the function of bringing the temperature of the bloom segments to values suitable for rolling, at least when the temperature at which they exit from the furnace is about 1050° C. or lower.

The inductor can be present in an intermediate position between the stands of the rolling mill.

According to a characteristic feature of the present invention, the axes of the casting machine and of the rolling mill are offset and parallel with respect to each other, which is why this configuration is suitable to make a semi-endless type process.

According to another characteristic feature of the invention, the maintenance and/or possible heating unit consists of a lateral transfer furnace which connects the two casting lines, each located on a respective casting axis, with the rolling line, located on a rolling axis, which is offset and parallel to the casting axes. The lateral transfer furnace is configured so as to compensate the different productivities of the continuous casting machine and the rolling mill.

The lateral transfer furnace has a length which can vary at least from 16 to 80 meters, in the specific case, but, according to a further characteristic feature of the present invention, the length is determined on each occasion in order to optimize the characteristics of the process, as will be explained in more detail hereafter.

In particular the length of the furnace is a determining planning parameter in sizing the line, in that it is the parameter which allows to identify the optimum compromise between productivity, energy saving, accumulation capacity, bulk, and more, as will be seen hereafter in the description.

In a preferred form of the invention, the lateral transfer furnace comprises two introduction rollerways, each of which is disposed in axis with one of the casting lines, operates at the rhythm of the continuous casting, and allows to continuously introduce the segments of bloom produced by the casting. The bloom segments entering from the introduction rollerways are transferred onto an adjacent support plane or buffer by means of transfer devices. An extraction device subsequently provides to remove the bloom segments from the buffer in order to dispose them on a removal rollerway which renders them available to the rolling line downstream.

In some forms of embodiment, both the introduction rollerways are provided with motorized drawing rollers to feed the bloom segments, which are assembled cantilevered toward the inside of the furnace and on drive shafts disposed transversely to the direction of feed of the rolled product.

According to a variant embodiment the rollers of the introduction rollerway further inside the furnace are assembled on shafts with double support which are disposed externally to the maintenance and heating furnace. In accordance with this variant, the drawing rollers of the innermost introduction rollerway are bigger than the rollers of the outermost introduction rollerway. This solution is advantageous in that it avoids having a great overhang of the shafts of the rollers of the innermost rollerway which could cause, in the case of bloom segments of a greater weight, considerable flexional stresses.

The introduction rollerway is aligned to the axis of the rolling mill, and operates at the rhythm of the rolling mill located downstream, so as to feed the bloom segments to the rolling mill downstream without any break in continuity, and the direction of feed of the rolled product inside it is the same as the direction of feed of the casting lines.

In this way, when the plant is working under normal conditions, the continuous casting and the rolling can operate in a substantially continuous condition, approaching an "endless" mode condition, even though they are working with segments sheared to size and with a rolling line misaligned with respect to the two casting lines.

The buffer also acts as an accumulation store for the blooms, for example when it is necessary to overcome an interruption in the rolling process, due to accidents or for a programmed roll-change or for change of production, in this way avoiding any losses of material and energy and, above all, avoiding any interruption of the casting. The furnace allows to accumulate blooms for a time that can even reach up to 60/80 minutes (at maximum casting speed) and more, and is in any case variable during the design of the plant.

This allows to considerably improve the plant utilization factor.

Thanks to the accumulation capacity of the furnace, the overall yield is also improved for the following reasons:

the number of casting re-starts is reduced or eliminated, with consequent saving of waste material at start and end of casting;

steel which at the moment of an accidental blockage in the rolling mill, for example due to a cobble, is to be found from the tundish (which unloads the liquid steel into the crystallizer) to the beginning of the rolling mill does not have to be scrapped, nor the steel remaining in the ladle, which often cannot be recovered;

in the event of an accidental blockage of the rolling mill, the bloom already gripped in one or more stands can be returned inside the furnace and kept there, also at temperature, preventing any segmentation and therefore any loss of material.

According to one formulation of the present invention, the optimum length of the bloom, and hence of the lateral transfer furnace that has to contain it, is chosen as a function of the reduction to a minimum of the linear combination of the heat losses in said furnace and the losses of material due to crops, short bars and cobbles.

According to one example of calculation, the function is expressed according to the following formula:

$$Ct=Ky\cdot Y+Ke\cdot E;$$

where the term Ke·E represents the economic loss caused by the energy consumption for maintaining and/or possibly heating the blooms, directly proportional to the length Lb of the bloom, while the term Ky·Y represents the economic loss caused by crops, cobbles and short bars in the rolling mill, inversely proportional to Lb.

Therefore, expressing the same as a function of only one variable, for example the length of the bloom to be processed, and identifying the minimum point of said function, the optimum length of the bloom is found. The lateral transfer furnace will have an optimum length at least equal to that of the bloom; advantageously an adequate safety margin is provided which takes into account possible blooms sheared out of tolerance, and also the necessary dimensional and constructional adaptations.

In this way, the optimum operating conditions for the coordination of the continuous casting machine and the rolling mill are identified.

In one form of embodiment, not restrictive, the plant comprises an additional reduction unit, consisting of at least a rolling stand, and is provided when rectangular sections are cast so as to return the wide cast section to a square, round or oval shape, or in any case less wide than the starting section, so that it is suitable to feed the rolling mill.

The additional unit is provided immediately downstream of the continuous casting machine, and on each casting line, when the speed of entrance into the first rolling stand is comprised between about 0.05 m/sec (or less) and about 0.08 msec. Since the reduction occurs on material that has just been cast, with a hot core, there are considerable advantages in terms of energy saving.

On the contrary, if the speed at entrance to the first stand is comprised between about 0.08 m/sec and about 0.1 m/sec (or higher), the unit is provided downstream of the lateral transfer furnace and therefore at the head of the rolling unit.

The present invention also concerns a rolling process for the production of long products, comprising a continuous casting step of blooms, a step of temperature maintenance and/or possible heating, and a rolling step, after the temperature maintenance and/or possible heating step, for the production of long rolled products.

According to a characteristic feature of the present invention, the continuous casting step is made in two casting lines, whereas the temperature maintenance and/or possible heating step provides to keep a plurality of segments of blooms, sheared to size, in a condition of lateral transfer inside a furnace, for a time correlated to the size in length and width of the furnace, and determined so as to optimize the operating connection between continuous casting and rolling. The process thus provides to define an accumulation store between casting and rolling where the blooms can remain for a period of time, which can be determined during the planning stage and can vary from 30 to 60/80 minutes or more, at maximum casting speed, and which is calculated in relation to the operating conditions of the plant and/or the maximum number of blooms that can be accumulated inside the furnace, in relation also to the section and length of the bloom.

In other forms of embodiment, the line according to the present invention comprises a first de-scaling device upstream of the lateral transfer furnace and/or a second de-scaling device downstream of the lateral transfer furnace.

BRIEF DESCRIPTION OF THE DRAWINGS

These and other characteristics of the present invention will become apparent from the following description of a preferential form of embodiment, given as a non-restrictive example with reference to the attached drawings wherein:

FIG. 6 shows a numerical example of sizing that uses the diagram in FIG. 5;

DETAILED DESCRIPTION OF SOME PREFERENTIAL FORMS OF EMBODIMENT

Figure 1:
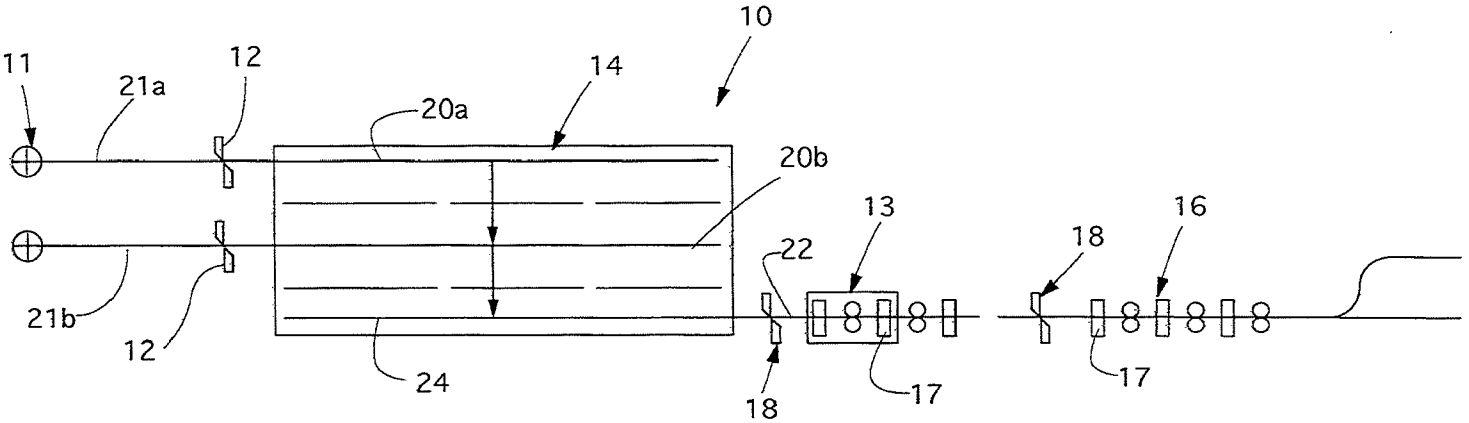
FIGS. 1-4 show four possible lay-outs of a rolling plant according to the present invention.

With reference to the attached drawings, FIG. 1 shows a first example of a lay-out 10 of a plant for the production of long products according to the present invention.

Figure 12:
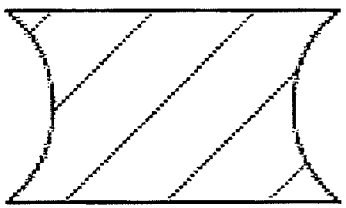
Figure 9:
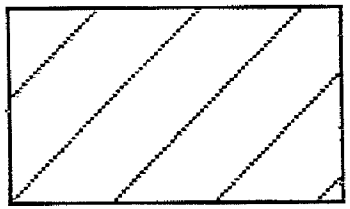
Figure 11:
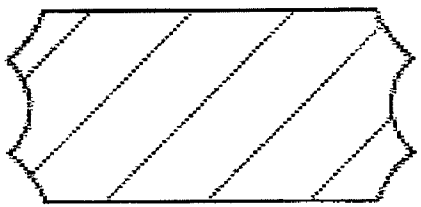

The lay-out 10 in FIG. 1 comprises, in the essential elements shown, a continuous casting machine 11 comprising two casting lines respectively 21*a* and 21*b*, which develop parallel to each other, each of which uses a crystallizer or other device suitable to cast blooms with a square or rectangular section and of various shapes and sizes, with straight, curved, concave or convex sides, or other. Some examples of sections that can be cast with the present invention are shown in FIGS. 9-12, which show respectively a rectangular section with straight and parallel sides (FIG. 9), a section with short sides with a convex curvature and straight and parallel long sides (FIG. 10), a section with short sides having a convex curvature at the center and with straight and parallel long sides (FIG. 11) and a section with short sides with a concave curvature and straight and parallel long sides (FIG. 12).

It is quite evident that the same considerations can also be made for blooms with a square section.

The two casting lines 21*a* and 21*b* (FIG. 1) are disposed on lines offset but parallel with respect to the rolling line 22 and both feed a single rolling mill 16 located downstream, which in turn defines a rolling line 22. In this way a discontinuous or semi-endless process is achieved, but with a performance that, as will be seen, and thanks to the sizing of the parameters provided in the present invention, is very close to that of a continuous or endless process.

The continuous casting machine 11 with two lines, according to the present invention, allows to obtain an hourly productivity which varies from 35 tons/h to 240 tons/h which corresponds to an annual productivity which varies from 600,000 tons/year to 1,500,000 tons/year.

More specifically, with casting speeds comprised between 4 and 7 m/min, in the case in which blooms with a square section and with sides comprised between 130 mm and 160 mm are cast, a total productivity comprised between 60 and 120 tons/h is reached, whilst in the case in which blooms with a rectangular section are cast, given the same casting speed and height of the rectangular section, a total productivity comprised between 60 and 240 tons/h can be reached.

Simply to give an example, the sections which can be cast, square or rectangular, can be chosen from 100 mm×100 mm, 130 mm×130 mm, 150 mm×150 mm, 160 mm×160 mm, 100 mm×140 mm, 130 mm×180 mm, 130 mm×210 mm, 140 mm×190 mm, 160 mm×210 mm, 160 mm×280 mm, 180 mm×300 mm, 200 mm×320 mm or intermediate dimensions. In the case of the production of average profiles, even bigger dimensional sections can be used, for example of about 300 mm×400 mm and similar.

Advantageously, in the case of rectangular sections, this casting and continuous rolling plant 10 allows to obtain blooms with a high metric weight given the same section height, or thickness.

Downstream of the each casting line 21*a*, 21*b* there are means for shearing to size 12, for example a shears or an oxyacetylene cutting torch, which shear the cast blooms into segments of a desired length. Advantageously, the blooms are cut into segments of a length from 1 to 10 times more than that in the state of the art and, according to the present invention, the length is comprised between 16 and 150 meters, preferably between 16 and 80 m, more preferably between 40 and 60 meters. In this way blooms of a great weight are obtained, from 5 to 20 times higher than in the state of the art which, according to the present invention, is comprised between 10 and 100 ton.

In this way, although all the lay-outs 10, 110, 210, 310 are configured as operating in semi-endless mode, in that they start from segments sheared to size, blooms of great length and great linear weight allow, during normal working conditions, to operate in a condition of substantial continuity, obtaining a performance very close to that of the endless mode.

Figure 2:
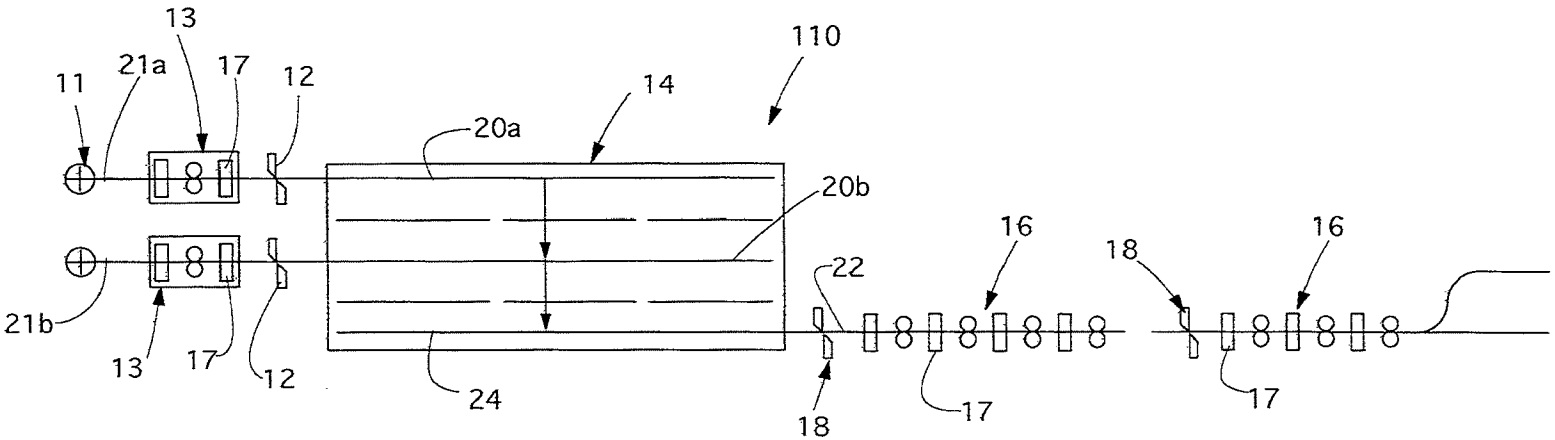
Figure 3:
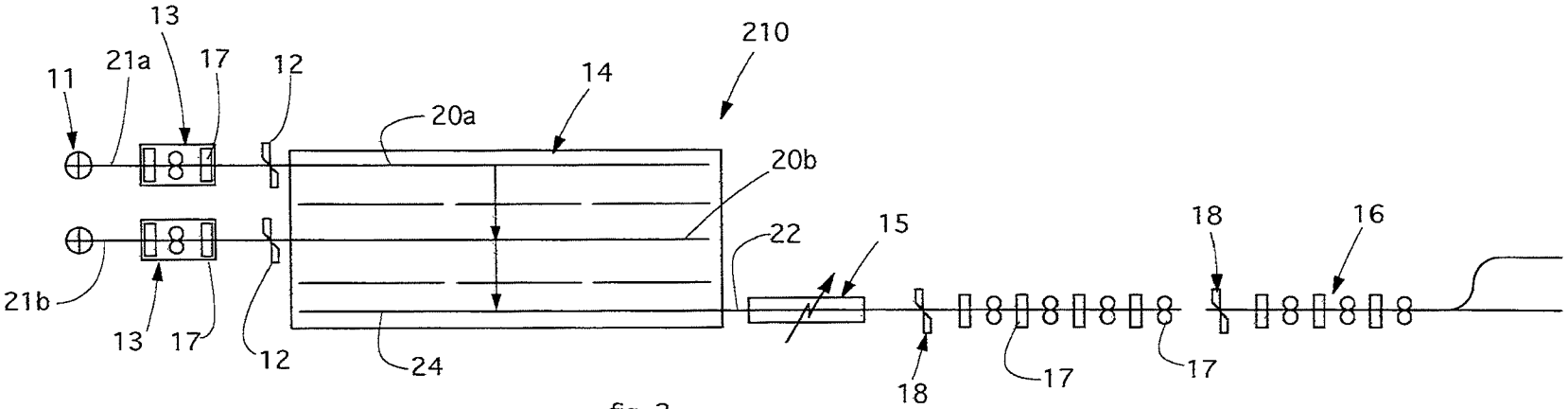

In the alternative lay-outs 110 and 210 in FIGS. 2 and 3, where the same reference numbers correspond to identical or equivalent components, in each of the two casting lines 21*a* and 21*b*, there is an additional reduction/roughing unit 13, generally consisting of 1 to 4 stands and, in this case, three alternating vertical/horizontal/vertical, or vertical/vertical/horizontal, rolling stands 17. It is also possible to use a single vertical stand. The stands 17 are used to return the cast section having a widened shape to a square, round, or oval section, or at least less widened than the starting section, in order to make it suitable for the rolling line 22 in the rolling mill 16 located downstream. Even though in the drawings the number of stands is 3, it is understood that the number can be chosen from 1 to 4, according to the overall design parameters of the casting lines 21*a* and 21*b* and to the products to be continuously cast.

The best position for the additional reduction/roughing unit 13 along each casting line 21*a* and 21*b* comprised from the end of casting to the beginning of the rolling mill 16 is established in relation to the speed obtainable at entrance to the first stand of the unit. For example (FIG. 2), if the speed is comprised between 3 and 4.8 m/min (0.05 m/sec and 0.08 m/sec), the reduction/roughing unit 13 is positioned immediately downstream of each casting line 21*a*, 21*b*, upstream of the shearing means 12, whereas if the speed at entrance to the stand is greater (FIG. 1), for example comprised between 5 and 9 m/min, the additional reduction/roughing unit 13 is put at the head of the rolling mill 16 and downstream of the heating and/or maintenance furnace 14, as we shall see hereafter.

Another parameter that can condition the choice of inserting the additional reduction/roughing unit 13 immediately downstream of the continuous casting machine and upstream of the shearing means 12 is the energy factor.

When the first reduction in section is performed immediately downstream of the continuous casting, immediately after the closing of the metallurgic cone, energy consumption is reduced since the reduction in section takes place on a product with a core that is still very hot, and therefore it is possible to use a lesser force of compression and to use smaller stands that require less power installed.

Downstream of the continuous casting machine 11*a* maintenance and/or possible heating furnace 14 is disposed (hereafter referred to simply as furnace), of the horizontal, lateral transfer type, which receives from the two casting lines 21*a* and 21*b* the segments of bloom supplied by casting and sheared to size by the shearing means 12, and feeds them to the rolling mill 16 located downstream along a rolling axis which is parallel to the axes of the two casting lines 21*a* and 21*b*.

Advantageously, the two casting lines 21*a*, 21*b* feed the blooms directly to the furnace 14, without intermediate movements and transfers, along a casting line and at an average temperature of at least 1000° C., preferably comprised between about 1100° C. and about 1150° C. The average temperature at which the bloom leaves the furnace 14 is instead comprised between about 1050° C. and 1200° C.

The two casting lines 21*a*, 21*b* cast two blooms in parallel, preferably with the same section, square or rectangular, which enter into the furnace 14 substantially aligned.

Figure 13:
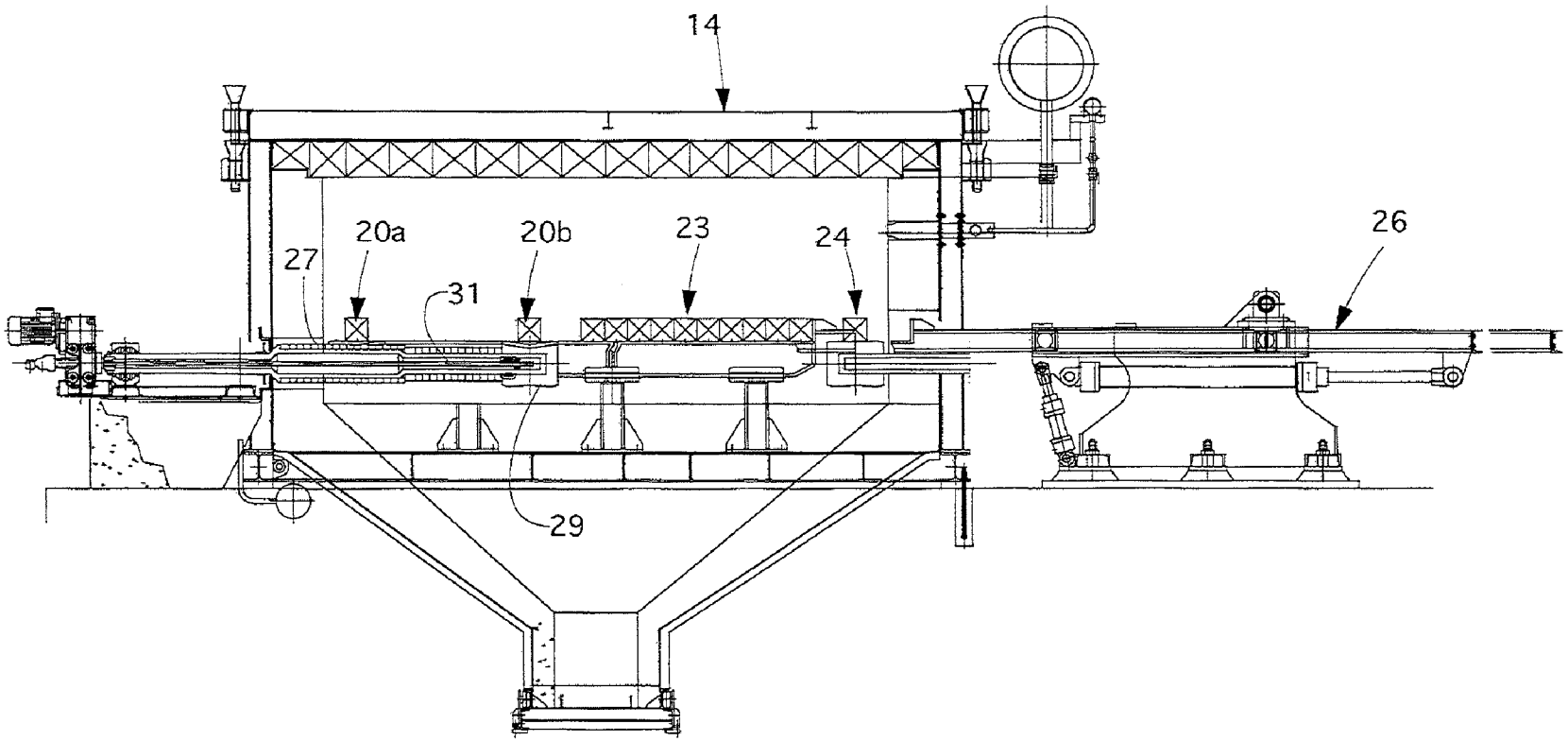
FIGS. 13 and 14 show two section views of a maintenance and/or possible heating furnace in two different positions.
Figure 14:
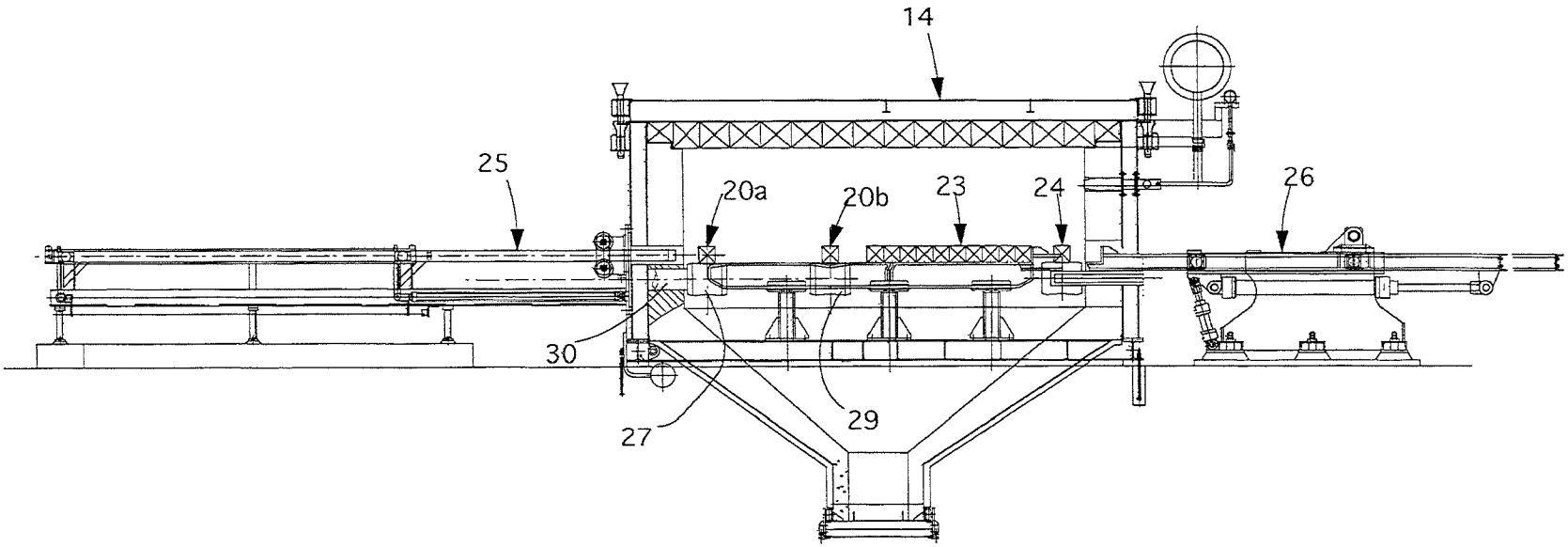

In particular, the furnace 14 (FIGS. 13 and 14) comprises a first and a second movement section 20*a* and 20*b* disposed in axis respectively with the two casting lines 21*a*, 21*b*, and a third movement section 24 located in correspondence with the rolling line 22, and a support plane 23, which also functions as an accumulation store, or buffer, to temporarily contain the bloom segments, and which is disposed between the second movement section 20*b* and the third movement section 24.

The first and the second movement section 20*a* and 20*b* each comprise an introduction rollerway, each provided with a plurality of motorized drawing rollers, 27, respectively 29, disposed offset and distanced from each other along the extension of feed of the blooms, which are mounted cantilevered on shafts 30 and respectively 31, and allow the bloom segments to advance into the furnace 14.

The third movement section 24 also consists of a rollerway, called the removal rollerway, the same as the introduction rollerway of the first introduction section 20*a*.

In particular, the shafts 31 of the motorized drawing rollers 29 of the second movement section 20*b*, given their big extensions projecting inside the furnace 14, and also given the high temperatures inside, are covered with rings of refractory material in order to protect them from heat stresses and hence to guarantee their mechanical resistance.

Figure 15:
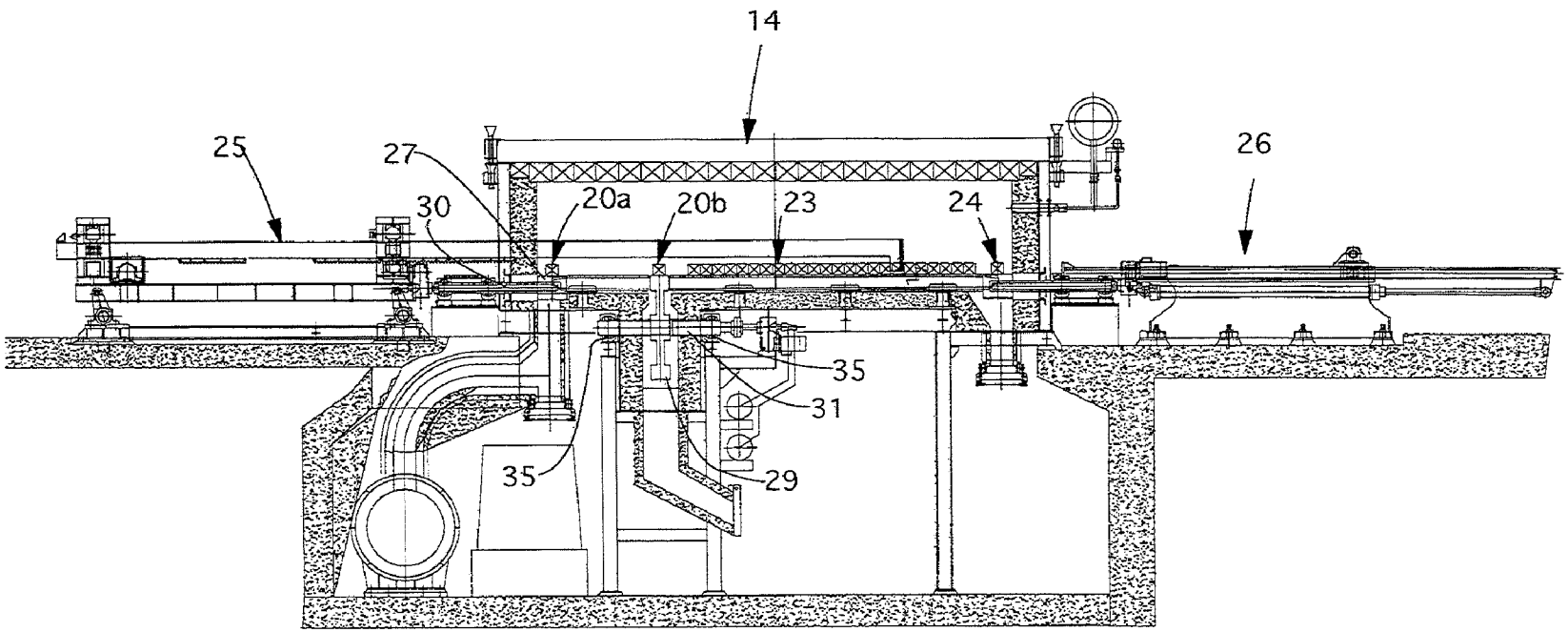
FIG. 15 shows a section view of a variant of the maintenance and/or possible heating furnace in FIGS. 13 and 14.

According to a constructional variant of the furnace 14 (FIG. 15), it can advantageously be provided that the drawing rollers 29 of the movement section 20*b* are bigger in diameter than the drawing rollers 27, and such that the shaft 31 of said rollers 29 finds itself completely outside the furnace 14 with the possibility of mounting it on a double support.

Each shaft 31 on which the roller 29 of the second movement section 20*b* are mounted is then mounted on a pair of bearings 35 disposed outside the furnace 14.

This constructional variant is advantageous especially if very heavy blooms are cast, since the shaft 31 on which the rollers of the second movement section 20*b* are mounted is less stressed both mechanically and thermally.

Inside the furnace 14 the necessary lateral connection is also achieved between the first and the second movement section 20*a* and 20*b* and the third movement section 24. To this purpose, the furnace 14 also comprises transfer devices 25 to transfer the bloom segments toward the support plane or buffer 23, and extraction devices 26 to pick up the bloom segments present in the buffer 23 and load them on the third movement section 24 which makes them available to the rolling line 22.

The transfer devices 25 provide to transfer the bloom segments from the first and second movement section 20*a* and 20*b* toward the buffer 23.

In this case, each transfer device 25 provides first to thrust the bloom segment from the first movement section 20*a*, which segment subsequently goes into contact with the bloom segment present on the second movement section 20*b*, so as to take them both to the buffer 23.

The positioning of the blooms on the buffer 23 depends on the particular operating condition of the plant. If the buffer is free, the blooms are positioned in the terminal zone thereof, adjacent to the third movement section 24; if there are other blooms already present on the buffer, or if the rolling mill has a productivity lower than that of the casting, or if the rolling line 22 is stopped for some reason, then the new blooms arriving are put in a queue after those already accumulated, and subsequently all of the buffered blooms are trusted together by said transfer devices toward the out position.

In another embodiment, the movement of the blooms placed on the buffer could be realized, instead of the above mentioned transfer devices, with a plurality of longitudinal walking beams of the furnace 14, which are provided of movement mechanisms. The extraction devices 26 pick up the bloom segments from the buffer 23 and dispose them on the third movement section 24 to send them to the rolling line 22 for the rolling step.

The transfer devices 25 operate, normally, at the same rhythm as the casting machine 11 disposed upstream, whereas the extraction devices 26 operate at the same rhythm of the rolling mill 16 located downstream of the furnace 14. Moreover, during the emptying of the buffer, also the transfer devices 25, or the walking beams in another embodiment, operate with the same rhythm as the rolling mill 16.

The furnace 14 not only creates the lateral connection between the two casting lines 21*a* and 21*b* and the rolling line 22, but also has at least the following functions and works with the following modes:

it functions as a chamber only to maintain the blooms at temperature. In this configuration the chamber guarantees that the temperature of the load is maintained between entrance and exit;

it functions as a heating furnace for the blooms. In this configuration the furnace 14 raises the temperature of the load between entrance and exit, for example to restore the temperature lost when the additional reduction unit 13 is provided immediately downstream of casting.

The maintenance and/or possible heating furnace 14 also functions as a lateral transfer store which can compensate the different productivities of the continuous casting machine 11 with two lines and the rolling mill 16 located downstream.

Furthermore, if there is an interruption in the functioning of the rolling mill 16, due to accidents or for a programmed roll-change or for change of production, the transfer devices 25 continue to accumulate inside the furnace the blooms arriving from the two casting lines 21*a*, 21*b* until the buffer 23 is full, whereas the extraction devices 26 remain still.

When the mill starts functioning again, the extraction devices 26 start their normal functioning cycle again, whereas the transfer devices 25 again proceed both to translate the blooms from the first and second movement section 20*a*, 20*b* to the buffer 23 and to translate all the blooms on the buffer to the out position from the furnace 14.

As we said above, the furnace 14, by means of the buffer 23, allows to carry out production changes, replacing some or all the stands of the rolling mill 16, offering the possibility of a buffer time of up to 60/80 minutes, without needing to stop or slow down the continuous casting machine 11.

The optimum length of the bloom cast by each casting line 21*a* and 21*b* can be chosen according to the reduction to the minimum of a function representing the specific total cost due to the loss of material and energy consumption, or the linear combination of the heat losses in the maintenance and/or possible heating furnace 14 and the losses of material due to crops, short bars and cobbles in the rolling mill 16.

To give an example, the function of the total cost Ct is expressed according to the following formula:

$$Ct=Cy+Ce$$

where:

Cy is the economic loss caused by crops, short bars and cobbles in the rolling mill, which is inversely proportional to the length of the bloom Lb and can also be expressed as Cy=Ky·Y, where Ky represents the unit cost for loss of material, while Y is a function that can be expressed as Y=fy/(Lb^g) or also as the ratio between (tons lost/tons produced) and where fy and g are constants connected to the production process or to the number of rolling stands, disposition of the shears, mill conformation, type of finishing, production variability.

Ce is the economic loss caused by the energy consumption for maintaining and/or possibly heating the blooms, which is directly proportional to the length of the bloom Lb, and can be expressed as Cy=Ke·E, where Ke is the unit cost of fuel for heating the furnace and E is a function that can be expressed as E=(NGk+NGv·Lb)/Pr [$Nm^3$/ton produced]. The terms NGk and NGv are parameters depending on the characteristics of the lateral furnace while Pr is the productivity of the plant.

Developing the function Ct as a function of the variable bloom length Lb to be worked, and identifying the minimum point of this function, we find the optimum length of the bloom optimized to reduce the total production costs. The furnace 14 which will have to contain them will have a length at least equal to that of the bloom segment to be heated. Advantageously an adequate safety margin is provided, which takes into account bloom segments that have been sheared out of tolerance, and also the necessary dimensional adjustments.

Therefore, the function specific total cost will be expressed as:

$$Ct=Ky\cdot fy/(Lb\hat{}g)+Ke\cdot(NGk+NGv\cdot Lb)/Pr$$

deriving and setting the derivative at zero we have:

$$DCt/DLb=Ky\cdot fy\cdot(-g)/(Lb\hat{}(g+1))+(Ke\cdot NGv)/Pr=0$$

from which $$Loptimum=[(Ky\cdot fy\cdot g\cdot Pr)/(Ke\cdot NGv)]\hat{}(1/(1+g))$$

Figure 5:
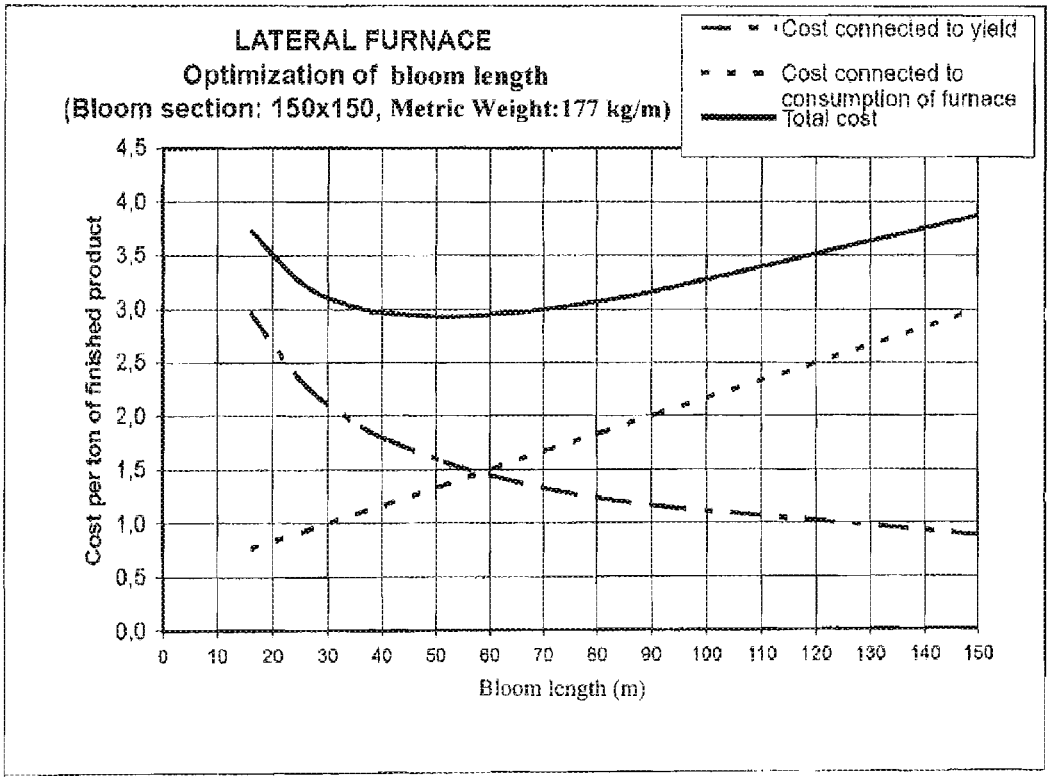
FIG. 5 shows a diagram for calculating the optimum length of the segment of bloom according to the present invention.

The graph in FIG. 5 shows the curves relating to the terms Cy and Ce.

For example, in the case (shown as an example in the diagram in FIG. 5) of a bloom sized 150 mm×150 mm, with a metric weight of 177 kg/m, and determining the coefficients suitably in accordance with experiments carried out by Applicant, we obtain a minimum point of the function expressed above, corresponding to an optimum length of the bloom (Loptimum) equal to about 52 m.

In this way, the optimum operating conditions are identified for the coordination of the continuous casting machine and the rolling mill.

The Table in FIG. 6 shows a comparison between a rolling plant for long products with two casting lines which produce a bloom with a square section 150×150, and a state-of-the-art rolling plant which, with the same productivity and cast section, uses four casting lines, always associated with only one rolling mill.

As can be seen from the Table, the optimized length of the bloom according to the invention is equal to 52 meters, and therefore is considerably greater, also in weight, than the corresponding values referring to the conventional plant with four casting lines.

The yield is much increased thanks to the reduced loss of material due to crops along the rolling mill 16 and due to the elimination of short bars.

Another parameter of particular relevance is the sharp reduction in the consumption of natural gas to feed the furnace 14, up to 50%, compared with traditional solutions.

Figure 7:
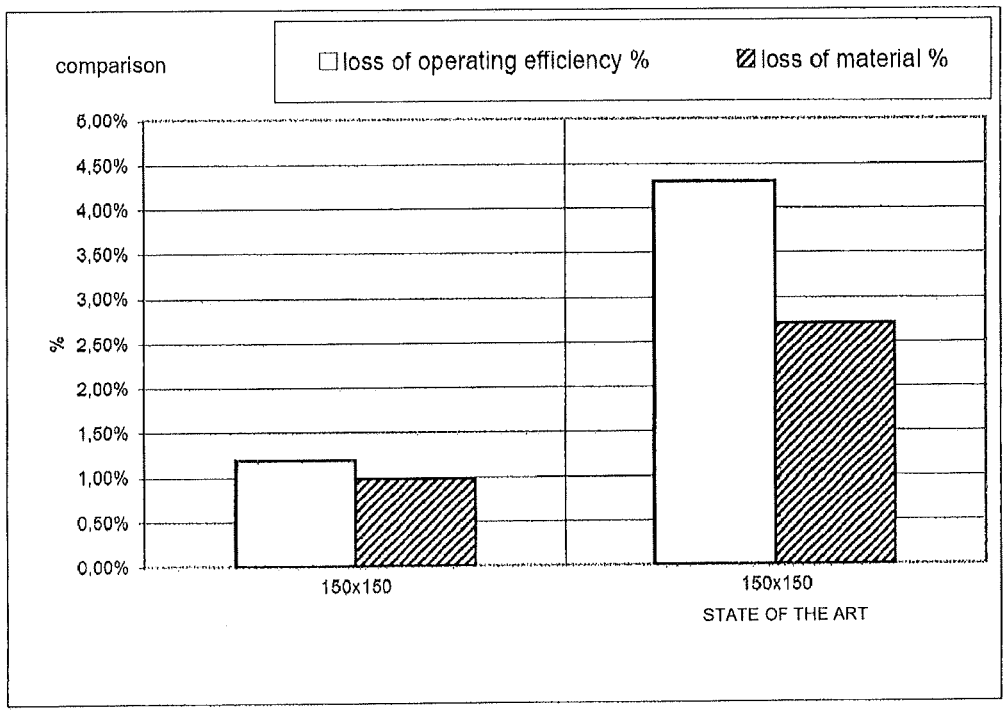
FIG. 7 shows respectively the savings in terms of operating efficiency and in terms of material of the solution according to the present invention and the state-of-the-art solution.

The graph in FIG. 7 shows a comparison between the solution according to the present invention (columns on the left) and the state-of-the-art solution (columns on the right) respectively of the savings in terms of operating efficiency (first column) and in terms of material (second column).

Figure 8:
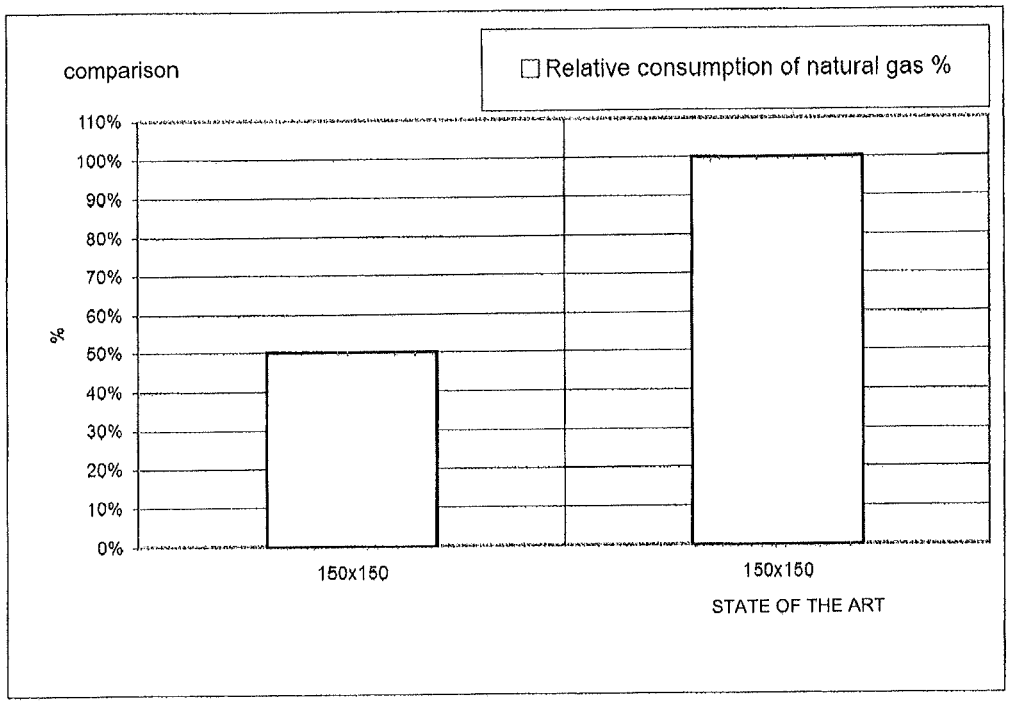
FIG. 8 shows respectively the consumption of natural gas of the solution according to the present invention and conventional solutions with multiple casting lines and bloom length less than 16 m.
Figure 10:
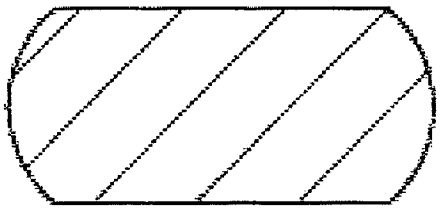
FIGS. 9-12 show examples of some different sections that can be cast with the plants in FIGS. 1-4.

The graph in FIG. 8 shows a comparison of the consumption of natural gas of the solution according to the present invention (columns on the left) and conventional solutions with multiple casting lines and bloom length less than 16 m (column on the right).

Figure 4:
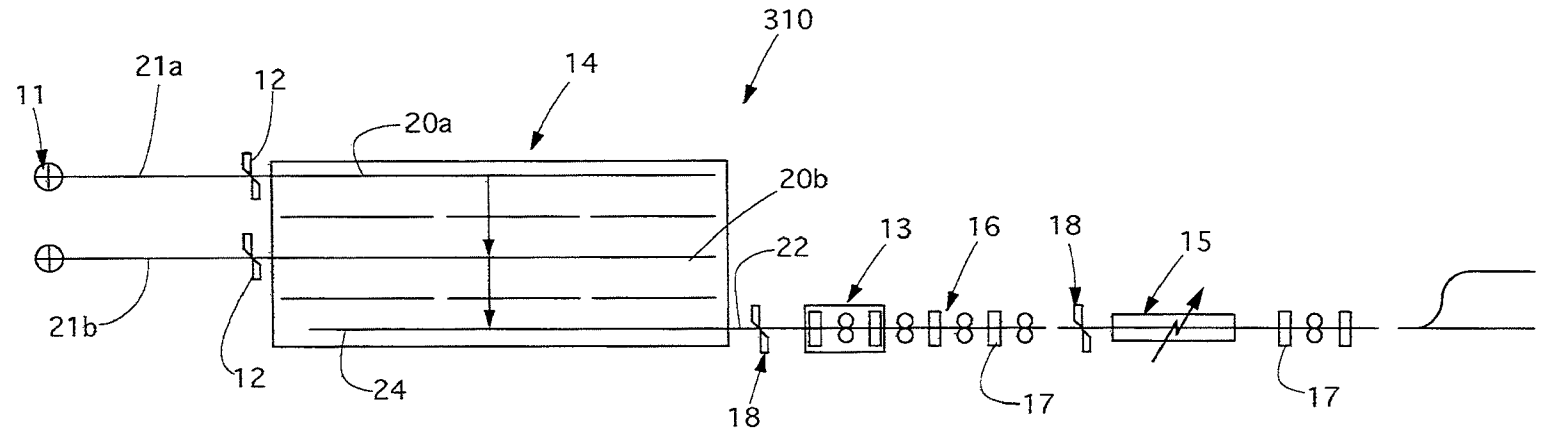

The lay-out 210 in FIG. 3 differs from those in FIGS. 1 and 2 in that it has an inductor 15 immediately at exit from the furnace 14, whereas the lay-out in FIG. 4 differs from the others in that the inductor 15 is located in an intermediate position between the stands 17 of the rolling mill 16.

The inductor has the function of taking the temperature of the blooms to values suitable for rolling, at least if the temperature at which they leave the furnace is about 1050° C. or lower. For example, when the additional reduction unit is provided immediately downstream of casting (FIG. 3) and the furnace 14 only performs maintenance, then the inductor 15 at exit from the furnace 14 provides to restore the temperature lost in said additional reduction unit 13.

The number of rolling stands 17 used in the mill 16 varies from 3-4 to 15-18 and more, depending on the type of final product to be obtained, the thickness of the cast product, the casting speed and still other parameters.

Upstream of the rolling mill 16, or in an intermediate position thereto, there may be cropping shears, oxyacetylene torches, emergency shears, scrapping shears, all identified generally with the reference number 18. Other components known in the state of the art, such as de-scalers, measurers, etc., not shown, are normally present along all the lay-outs 10, 110, 210, 310 present in the attached drawings.

The invention claimed is:

1. A method to make long metal rolled products, comprising the following steps:

continuous casting, made by a continuous casting machine including two casting lines, each of said two casting lines casting a cast product with a square, rectangular or equivalent section, wherein the section has a ratio of a longer side to a shorter side which is 1 to 41;

shearing to size each of the cast products by each of the two casting lines to define a segment in each of the cast products, the segment having 16 to 150 m in length, and 10 to 100 tons in weight;

direct introduction of each segment, each segment having an average temperature of 1000° C.-1150° C., into a maintenance and/or possible heating furnace, wherein the maintenance and/or heating furnace includes a first and a second movement sections, each of the first and the second movement sections disposed in axis respectively with each one of the two casting lines to receive each segment respectively;

lateral transfer of each segment inside the maintenance and/or heating furnace transferring each segment to a third movement section disposed parallel and misaligned with respect to said first and said second movement sections and aligned to a rolling axis of a rolling line parallel and offset and disposed sideways, on a same side with respect to the two casting lines;

reduction of the section in a rolling mill defining said rolling axis; and reduction/roughing of each cast product carried out by at least one additional reduction unit, the at least one additional reduction unit includes a rolling stand, wherein said reduction/roughing of the cast product is upstream of the maintenance and/or heating furnace when an entrance speed into the rolling stand of said additional reduction unit is less than about 0.08 m/s, and wherein said reduction/roughing of the cast product being downstream of the maintenance and/or heating furnace when the entrance speed into the rolling stand of said additional reduction unit is about 0.08 m/s or greater.

2. The method as in claim 1, wherein the length of said each segment sheared to size, to which the length of the maintenance and/or heating furnace is correlated, is calculated according to the reduction to a minimum of a linear combination of heat losses in the maintenance and/or heating furnace and losses of material, using the following formula:

$$Ct=Ky\cdot Y+Ke\cdot E;$$

wherein Ke·E represents economic loss caused by the energy consumption of the furnace, and Ky·Y represents economic loss caused by the losses of material due to the shearing of leading and tail ends leading to crops, cobbles and short bars in the rolling mill.

3. The method as in claim 1, wherein said continuous casting machine comprising the two casting lines operates at a casting speed of 3 to 9 m/min.

4. The method as in claim 1, wherein the section of each of the cast products has a surface having equivalent sides from 100 to 300 mm.

5. The method as in claim 1, the method further comprising a rapid heating step carried out by an inductor located immediately at an exit of the heating and/or maintenance furnace, and/or in an intermediate position between stands of the rolling mill.

6. The method as in claim 1, wherein said reduction/roughing of each cast product is upstream of the maintenance and/or heating furnace, and the entrance speed into the rolling stand of said additional reduction unit is between about 0.05 m/s to about 0.08 m/s.

7. The method as in claim 1, wherein said reduction/roughing of each cast product is downstream of the maintenance and/or heating furnace, and the entrance speed into the rolling stand of said additional reduction unit is between about 0.08 m/s to about 0.1 m/s.

* * * * *